US005977493A

United States Patent [19]

Tanaka

[11] Patent Number: 5,977,493

[45] Date of Patent: Nov. 2, 1999

[54] SWIMMING RACE TOUCH PANEL

[75] Inventor: Hiroshi Tanaka, Chiba, Japan

[73] Assignee: Seiko Instruments Inc., Japan

[21] Appl. No.: 09/061,801

[22] Filed: Apr. 16, 1998

[51] Int. Cl.[6] ..... H01H 35/00

[52] U.S. Cl. ..... 200/52 R; 200/85 R; 472/85

[58] Field of Search ..... 200/52 R, 85 R, 200/86 R; 340/323 R; 482/855; 472/85; 160/10, 368.1, 371; 4/505; 368/10

[56] References Cited

U.S. PATENT DOCUMENTS

| | | | |
|---|---|---|---|
| 3,302,007 | 1/1967 | Parkinson | 340/323 R X |
| 3,678,496 | 7/1972 | Stalp | 340/323 R X |
| 3,745,275 | 7/1973 | Degiez | 200/52 R X |
| 3,784,768 | 1/1974 | Hunt | 200/52 R |
| 3,916,214 | 10/1975 | Coble, Jr. et al. | 200/52 R X |
| 4,006,364 | 2/1977 | Suter | 340/323 R X |
| 4,117,283 | 9/1978 | Hurzeller et al. | 200/52 R X |
| 5,349,569 | 9/1994 | Tanaka | 200/52 R X |

*Primary Examiner*—J. R. Scott
*Attorney, Agent, or Firm*—Adams & Wilks

[57] ABSTRACT

A touch panel for a swimming race comprises a rear panel, a front panel spaced from and opposed to the rear panel and movable vertically and horizontally relative to the rear panel, and a top edge panel having a first end portion connected to the rear panel and a second end portion connected to the front panel. A sensor is mounted in the space between the front panel and the rear panel and is actuable in response to rearward horizontal movement of the front panel for generating a signal. An elastic member is movably disposed in a space defined by the front panel, the rear panel and the top edge panel for biasing the top edge panel and the front panel vertically upwardly. A sliding member is disposed between the elastic member and the rear panel for reducing a friction between the elastic member and the rear panel during movement of the elastic member.

30 Claims, 5 Drawing Sheets

Prior Art

SWIMMING RACE TOUCH PANEL

BACKGROUND OF THE INVENTION

This invention relates to a time recording system having a touch panel for swimming races. A conventional touch panel for swimming races depends on the working of a sensor 4 inserted between a rear panel 3 and a front panel 2 as shown in FIG. 2, and is incorporated in a system to detect the touch action of a swimming athlete. The rear panel 3 has a vertical portion 31 and a horizontal portion 32. In this time recording system, the front panel 2 is supported via a top edge panel 1 which is so constructed that one end is fixed with a screw 8, and the other end bites the front panel 2 in cooperation with an elastic member 6. Further, the elastic member 6, as shown in FIG. 4*a*, has two openings 11A and 11B on its vertical surface for receiving supporting members 11 (FIG. 7), and the front panel is fixed with either of these supporting members. Furthermore, as shown in FIGS. 4*a*, 4*b*, the horizontal surface of elastic member 6 has a fold 12 near its edge 9 forming an angled portion 16. Lastly, the sensor 4 for detecting the touch action of a swimming athlete is stored in a sensor storing bag 5, and this sensor storing bag 5 has a hole 14 in the form of a triangle to drain water, as shown in FIGS. 6 and 7.

With a conventional touch panel, as shown in FIG. 7, the angled portion 16 of the elastic member 6 often firmly adheres to the inner wall of top edge panel 1, which might lead to continuous activation of the sensor 4 which, therefore, could not detect the action of the touch panel. Further, the elastic member 6 has two supporting members 11, either of which is used to support the front panel 2. Thus, if an obliquely directing force acts on the touch panel, one supporting member might be raised with respect to the other, which might cause the elastic member 6 to be tilted and one side of the angled portion 16 of the elastic member might adhere firmly to the inner wall of the top edge panel 1. This might lead to continuous activation of the sensor.

Furthermore, since the contact surface between a sliding member and the elastic member forms a line at the edge of elastic member which is normal to the direction along which sliding takes place, thereby causing an increased friction is generated when sliding occurs. Therefore, sliding does not proceed smoothly which might interfere with the normal operation of sensor.

Lastly, with the conventional touch panel, when a swimming athlete kicks the touch panel with his feet to make a turn, it might lead to breakage of the sensor storing bag because of drainage of water from its water draining hole being insufficient.

SUMMARY OF THE INVENTION

With this invention, an elastic member is so designed as to have a shape which will improve the sliding performance of the elastic member against a sliding section to ensure a normal operation of the front panel. Further, a water draining hole is so designed as to have a structure sufficiently strong to endure forces generated during spurting-out of water from the sensor storing bag.

DETAILED DESCRIPTION OF THE PREFERRED EMBODIMENT

In the touch panel according to the present invention, an elastic member which transmits a movement of a front panel to a sensor is designed to have the following structural features. Firstly, near an edge of a horizontal section of the elastic member, there is a circular section which has a spherical portion directed downwardly from a surface of the horizontal section to contact with an upper surface of a rear panel.

Secondly, the edge of the horizontal section of the elastic member is so prepared as to have a round contour.

Thirdly, a sliding member is inserted between the horizontal section of the elastic member and the rear panel.

Fourthly, only one supporting section to support the front panel to the elastic member is prepared at a center of a vertical section of the elastic member.

Still further, a water draining hole of a sensor storing bag is so arranged as to have its center to be located in the interior of the sensor storing bag, and to allow the circumference of the sensor storing bag to pass through two points on the circumference of the water draining hole.

Figure 1:
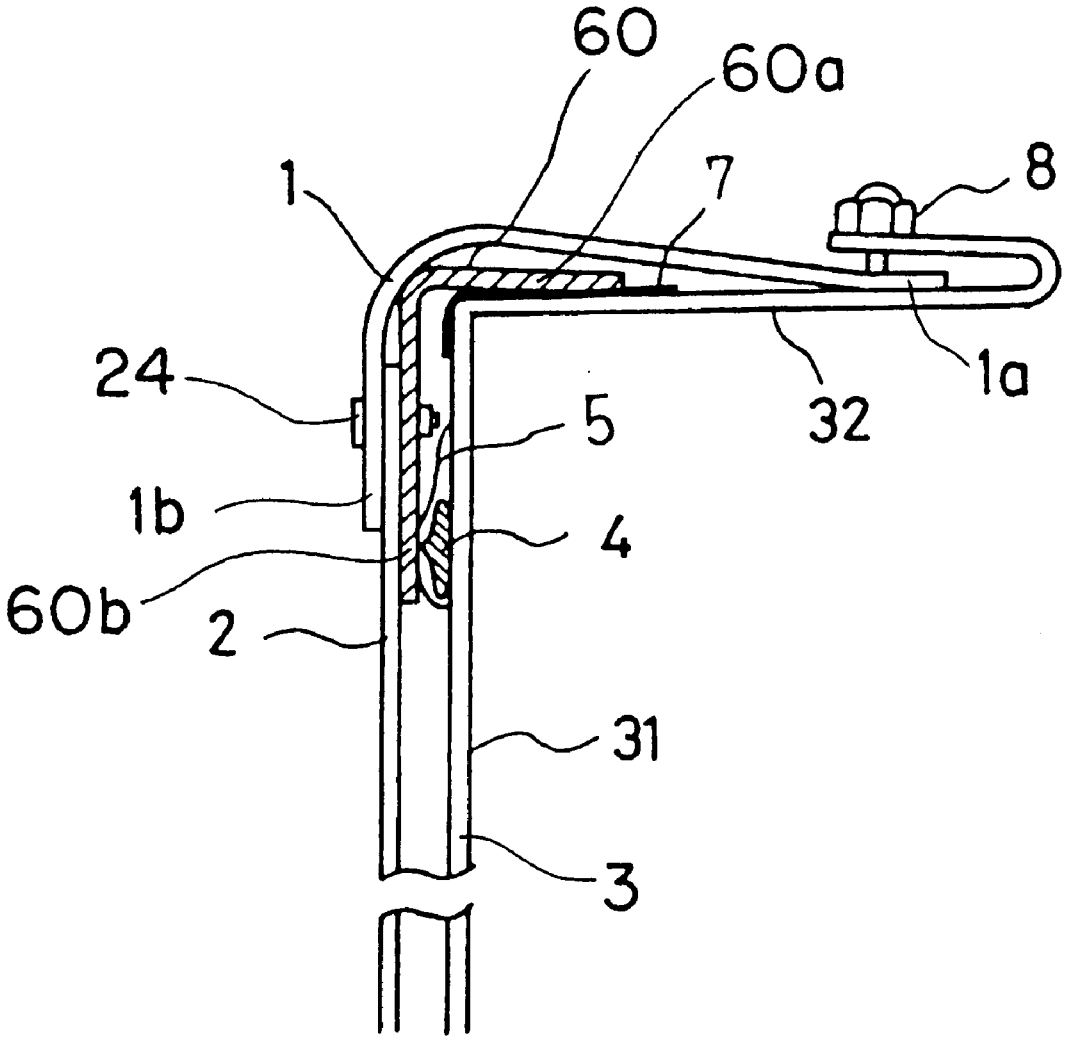
FIG. 1 is a sectional view of the touch panel according to the present invention.
Figure 2:
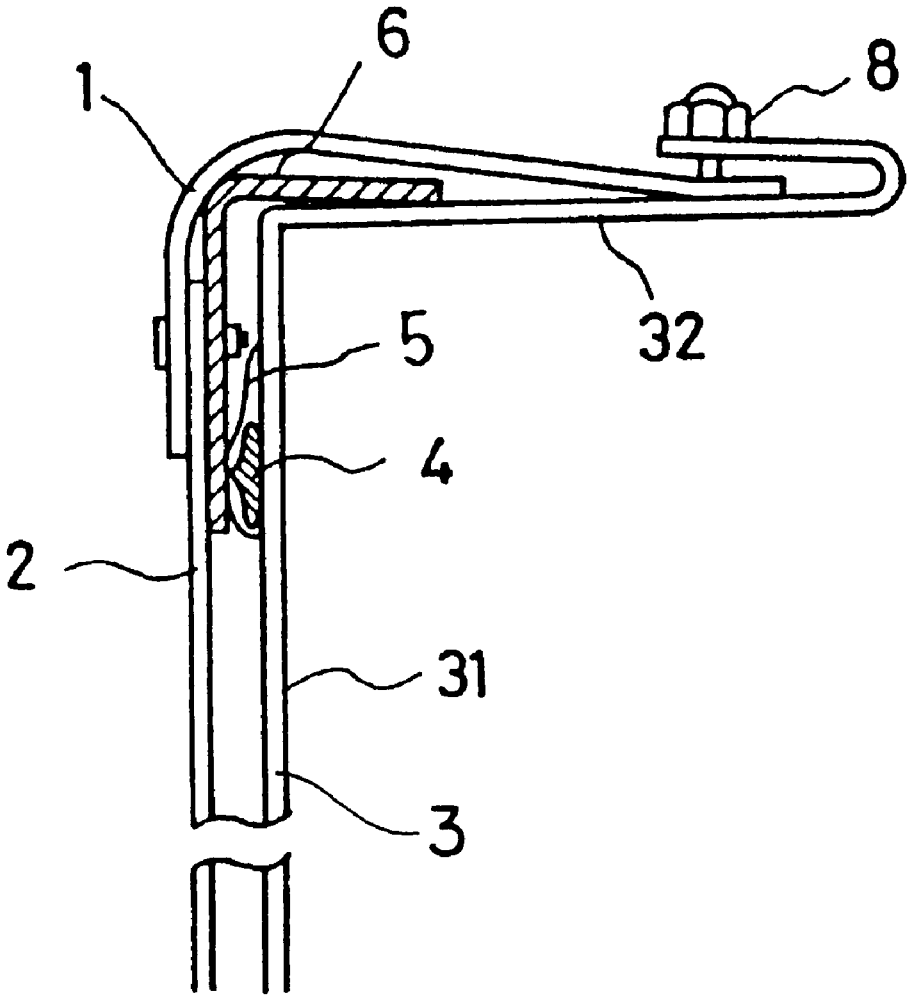
FIG. 2 is a sectional view of a conventional touch panel.
Figure 3A:
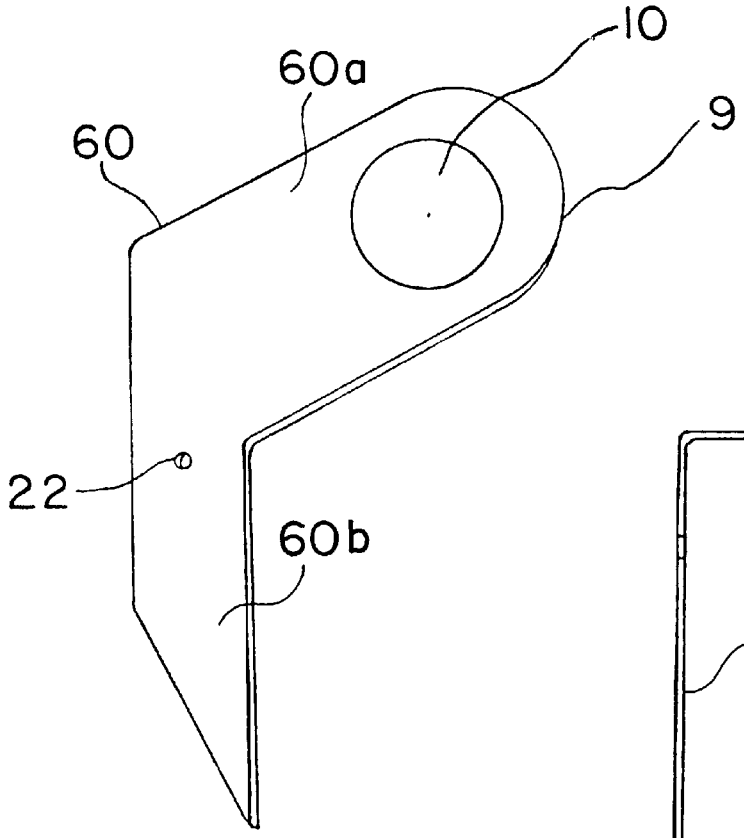
FIGS. 3*a* and 3*b* are a perspective view and a side view, respectively, of an elastic member according to the present invention.
Figure 3B:
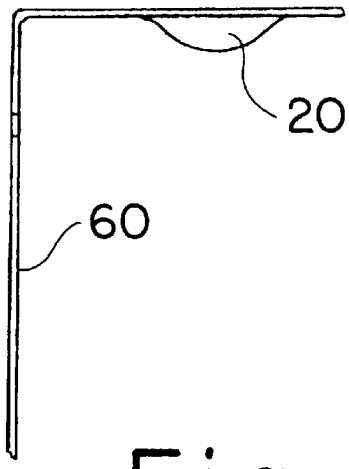
Figure 4A:
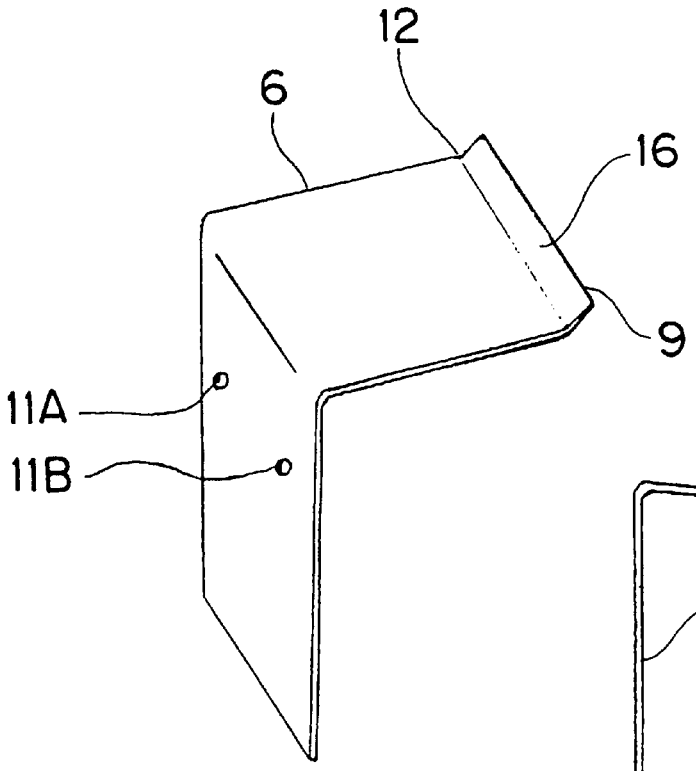
FIGS. 4*a* and 4*b* are a perspective view and a side view, respectively, of a conventional elastic member.
Figure 4B:
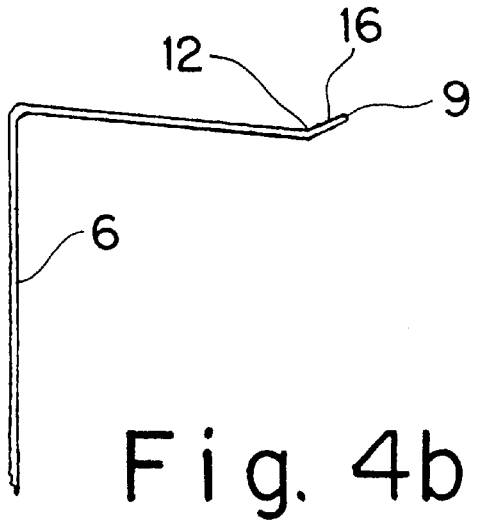
Fig. 4b Prior Art

An example will be described with reference to the attached figures. As shown in FIGS. 1, 3*a* and 3*b*, near the edge of a horizontal section 60*a* of an elastic member 60, a spherical indentation 10 is formed on an upper surface of the horizontal section 60*a* which extends from a lower surface thereof as a spherical portion 20. An edge 9 of the horizontal section 60*a* of the elastic member 60 has a round contour. Furthermore, only one opening 22 for receiving a support member 24 is disposed at a central portion of a vertical section 60*b* of the elastic member 60, and a front panel 2 is fixed with the support member. The front panel 2 is supported via a top edge panel 1 having an end portion la fixed to a rear panel 3 and an opposite end portion lb connected to the front panel 2 in cooperation with the elastic member 60. In addition, a sliding member 7 made of polytetrafluoroethylene is arranged between a horizontal portion 32 of the rear panel 3 and the elastic member 60 as shown in FIG. 1. A sensor 4 is inserted between the rear panel 3 and the front panel 2 and is secured to a vertical portion 31 of the rear panel 3.

Figure 5:
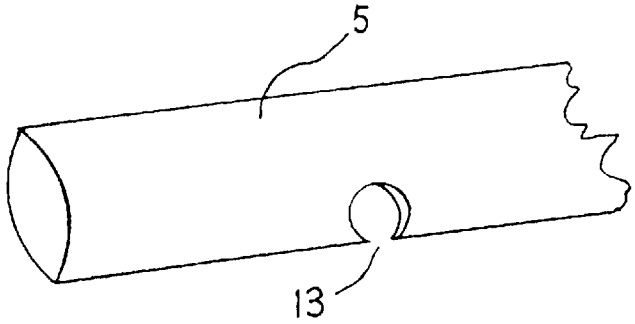
FIG. 5 is perspective view of a sensor storing bag according to the present invention.
Figure 6:
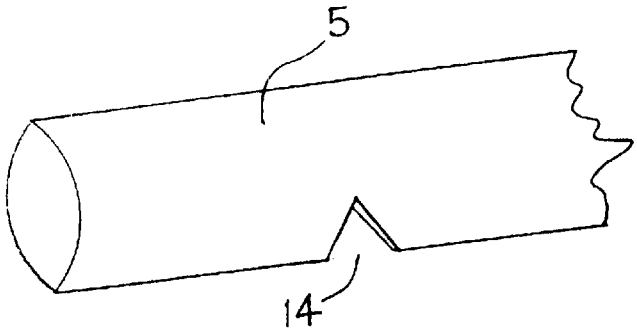
Fig. 6 Prior Art
FIG. 6 is perspective view of a conventional sensor storing bag.
Figure 7:
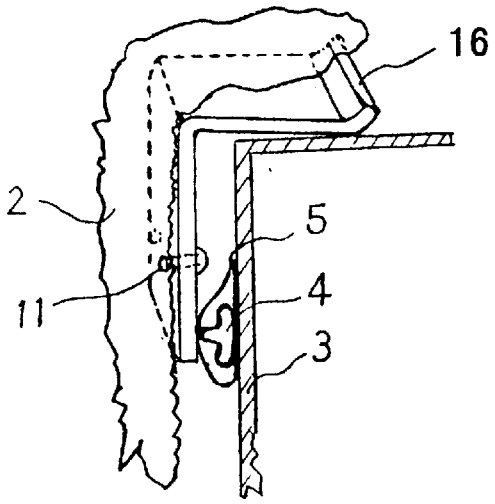
Fig. 7 Prior Art
FIG. 7 is perspective view of a conventional touch panel.

Referring to FIG. 5, a water draining hole 13 having a generally circular cross-section is formed on the sensor storing bag 5 such that two points of the circumference of the water draining hole 13 contact with the circumference of the sensor storing bag, and that a center of the water draining hole 13 is located in the interior of the sensor storing bag.

This invention is put into practice after taking a form as represented by the example described above, and gives advantages as will be described below.

The elastic member 60 is provided with the spherical portion 20 which contacts an upper surface of the sliding member 7 to prevent a shift of the touch panel from the vertical direction and prevent firm adherence of the elastic member 60 to the top edge panel 1, thereby preventing erroneous operation of the sensor in detecting the touch action. Further, the sliding member is disposed between the elastic member 60 which reduces a friction experienced by the elastic member during sliding, smoothens the movement of the top edge panel 1, and prevents erroneous operation of the sensor.

Moreover, the horizontal section 60*a* of the elastic member 60 has the edge 9 having a generally circular shape. Thus, the edge 9 of the elastic member 60 contacts the top edge panel 1 with a circular contact surface rather than straight contact surface. This feature prevents firm adherence of the elastic member 60 to the top edge panel 1.

Moreover, the provision of only one opening 22 for receiving a supporting member to support the front panel at the center of the vertical section 60*b* of the elastic member 60 allows one to correct a shift of the front panel 2 from the vertical line, smoothens the sliding movement of elastic member, and prevents erroneous operation of the sensor. Furthermore, the circular water draining hole 13 on the sensor storing bag 5 allows the bag to have so strong a structure as to endure pressures received from the front panel 2 when the panel is kicked by a swimming athlete, and thus prevents breakage of the sensor storing bag 5.

I claim:

1. A touch panel for a swimming race comprising:

a rear panel;

a front panel spaced from and opposed to the rear panel and movable vertically and horizontally relative to the rear panel;

a top edge panel having a first end portion connected to the rear panel and a second end portion connected to the front panel;

a sensor mounted in the space between the front panel and the rear panel and actuable in response to rearward horizontal movement of the front panel for generating a signal;

an elastic member movably disposed in a space defined by the front panel, the rear panel and the top edge panel for biasing the top edge panel and the front panel vertically upwardly; and a sliding member disposed between the elastic member and the rear panel for reducing a friction between the elastic member and the rear panel during movement of the elastic member.

2. A touch panel for a swimming race as claimed in claim 1; wherein the elastic member has a spherical portion disposed on a surface of the elastic member and in contact with the sliding member.

3. A touch panel for a swimming race as claimed in claim 1; wherein the elastic member has a terminal edge portion in contact with the sliding member, the terminal edge portion having a circular contour.

4. A touch panel for a swimming race as claimed in claim 1; wherein the elastic member has a leg portion fixed to the front panel and the top edge panel by a single connecting member.

5. A touch panel for a swimming race as claimed in claim 1; wherein the sliding member is made of polytetrafluoroethylene.

6. A touch panel for a swimming race as claimed in claim 1; further comprising a bag for storing the sensor, the bag having a water drainage hole for draining water.

7. A touch panel according to claim 1; wherein the elastic member has a first leg portion fixed to the front panel and a second leg portion disposed in contact with the sliding member, the elastic member being responsive to a force applied vertically downwardly to the top edge panel to enable vertical downward movement of the front panel without affecting actuation of the sensor.

8. A touch panel according to claim 1; wherein the rear panel has a vertical portion supporting the sensor and a support portion connected to the vertical portion, the sliding member being disposed on the support portion of the rear panel.

9. A touch panel according to claim 8; wherein the elastic member has a first leg portion fixed to the front panel and a second leg portion disposed in contact with the sliding member, the elastic member being responsive to a force applied obliquely to the top edge panel to enable rearward horizontal movement of the front panel to actuate the sensor and being responsive to a force applied vertically downwardly to the top edge panel to enable vertical downward movement of the front panel without affecting actuation of the sensor.

10. A touch panel according to claim 6; wherein the water drainage hole has a generally circular cross-section.

11. A touch panel according to claim 10; wherein a center of the water drainage hole is disposed in the bag.

12. A touch panel for a swimming race comprising: a rear panel having a vertical portion and a support portion connected to the vertical portion and supportable on an edge of a swimming pool so that the vertical portion is suspended on a wall of the swimming pool; a front panel spaced from and opposed to the vertical portion of the rear panel and movable vertically and horizontally relative to the rear panel; a top edge panel having an end connected to an upper part of the front panel, the top edge panel extending rearwardly to cover the space between the front panel and the rear panel; switch means mounted in the space between the front panel and the rear panel and actuatable in response to rearward horizontal movement of the front panel for generating a touch signal; elastic biasing means movably disposed in a space defined by the front panel, the rear panel and the top edge panel for biasing the top edge panel and the front panel vertically upwardly, the elastic biasing means being responsive to a force applied vertically downwardly to the top edge panel to enable vertical downward movement of the front panel without affecting actuation of the switching means; and a sliding member disposed between the elastic biasing means and the rear panel for reducing a friction between the elastic biasing means and the support portion of the rear panel during movement of the elastic biasing means.

13. A touch panel according to claim 12; wherein the elastic biasing means comprises an elastic member having a first portion extending rearwardly between the top edge panel and the support portion of the rear panel, the first portion of the elastic member having a spherical portion in contact with an upper surface of the sliding member.

14. A touch panel according to claim 13; wherein the elastic member has a second portion extending downwardly in the space between the front panel and the vertical portion of the rear member.

15. A touch panel according to claim 12; wherein the elastic biasing means comprises an elastic member having a terminal edge portion in contact with the sliding member, the terminal edge portion having a generally circular shape.

16. A touch panel for a swimming race as claimed in claim 12; wherein the elastic biasing means comprises an elastic member having a leg portion extending downwardly in the space between the front panel and the vertical portion of the rear member, the leg portion being integrally connected to a front end portion of the top edge panel and the upper part of the front panel.

17. A touch panel according to claim 16; further comprising single connecting member for integrally connecting the leg portion of the elastic member to the front end portion of the top edge panel and the upper part of the front panel.

18. A touch panel according to claim 12; wherein the sliding member is made of polytetrafluoroethylene.

19. A touch panel according to claim 12; further comprising a bag for storing the switch means, the bag having a water drainage hole for draining water.

20. A touch panel according to claim 19; wherein the water drainage hole has a generally circular cross-section.

21. A touch panel according to claim 20; wherein a center of the water drainage hole is disposed in the bag.

22. A touch panel for a swimming race comprising: a rear panel having a vertical portion and a support portion connected to the vertical portion and supportable on an edge of a swimming pool so that the vertical portion is suspended on a wall of the swimming pool; a front panel spaced from and opposed to the vertical portion of the rear panel and movable vertically and horizontally relative to the rear panel; a top edge panel having an end connected to an upper part of the front panel, the top edge panel extending rearwardly to cover the space between the front panel and the rear panel; switch means mounted in the space between the front panel and the rear panel and actuatable in response to rearward horizontal movement of the front panel for generating a touch signal; elastic biasing means movably disposed in a space defined by the front panel, the rear panel and the top edge panel for biasing the top edge panel and the front panel vertically upwardly; and a tubular sheath for storing the switch means, the tubular sheath having a water drainage hole for draining water from the tubular sheath, the drainage hole having a generally circular cross-section.

23. A touch panel for suspension on the wall of a swimming pool for generating a touch signal when touched by a swimmer, the touch panel comprising: a rear member having a vertical portion and a support portion connected to the vertical portion and supportable on an edge of a swimming pool so that the vertical portion is suspended on a wall of the swimming pool; a front member spaced from and opposed to the vertical portion of the rear member and movable vertically and horizontally relative to the rear member; a top edge member having a front end connected to an upper part of the rear member support portion, the top edge member extending rearwardly to cover the space between the front and rear members; a sensor mounted in the space between the front and rear members and actuatable in response to rearward horizontal movement of the front member caused by a swimmer touching the front member for generating a touch signal; an elastic member movably disposed in a space defined by the front, rear and top edge members for biasing the top edge member and thus the front member vertically upwardly; and a sliding member disposed between the elastic member and the upper part of the rear member support portion for reducing a friction between the elastic member and the rear member during movement of the elastic member.

24. A touch panel according to claim 23; wherein the elastic member has a spherical portion disposed on a surface of the elastic member and in contact with the sliding member.

25. A touch panel according to claim 23; wherein the elastic member has a terminal edge portion in contact with the sliding member, the terminal edge portion having a generally circular shape.

26. A touch panel according to claim 23; wherein the elastic member has a leg portion fixed to the front member and the top edge member by a single connecting member.

27. A touch panel according to claim 23; wherein the sliding member is made of polytetrafluoroethylene.

28. A touch panel according to claim 23; further comprising a tubular sheath for storing the sensor, the tubular sheath having a water drainage hole for draining water.

29. A touch panel according to claim 28; wherein the water drainage hole has a generally circular cross-section.

30. A touch panel according to claim 23; wherein the elastic member has a first leg portion fixed to the front member and the top edge member, and a second leg portion disposed in contact with the sliding member, the elastic member being responsive to a force applied obliquely to the top edge member to enable rearward horizontal movement of the front member to actuate the sensor and being responsive to a force applied vertically downwardly to the top edge member to enable vertical downward movement of the front member without affecting actuation of the sensor.

* * * * *